US005205644A

United States Patent [19]

Bayer et al.

[11] Patent Number: 5,205,644

[45] Date of Patent: Apr. 27, 1993

[54] RELAMPABLE CHANDELIER BASKET

[75] Inventors: George Bayer, Plattsburg; Daniel Tucker, Chazy, both of N.Y.

[73] Assignee: A. Schonbek & Co., Plattsburgh, N.Y.

[21] Appl. No.: 725,634

[22] Filed: Jul. 3, 1991

[51] Int. Cl.[5] ..... F21S 1/06

[52] U.S. Cl. ..... 362/405; 362/451; 362/277

[58] Field of Search ..... 362/404, 405, 406, 407, 362/408, 416, 417, 418, 419, 806, 147, 277, 290, 451

[56] References Cited

U.S. PATENT DOCUMENTS

| | | | |
|---|---|---|---|
| 489,173 | 1/1893 | Wilcox | 362/418 |
| 1,275,827 | 8/1918 | Ankele | 362/408 |
| 1,764,393 | 6/1930 | Doane | 362/408 |

*Primary Examiner*—Allen M. Ostrager
*Assistant Examiner*—L. Heyman
*Attorney, Agent, or Firm*—Wolf, Greenfield & Sacks

[57] ABSTRACT

The invention provides a two piece chandelier securable at two discrete positions. An upper and lower framework are moveable with respect to one another along a displacement axis and are securable in an access position and a decorative position, whereby access to an internal component of the chandelier such as a lighting element is facilitated in the access position relative to the decorative position.

29 Claims, 9 Drawing Sheets

RELAMPABLE CHANDELIER BASKET

BACKGROUND OF THE INVENTION

The invention involves an improvement to chandeliers of the type in which an object is substantially enclosed within the framework of the chandelier. For example, when a chandelier framework is in the form of a cage or basket, that is, when the framework has a plurality of co axial rings, access to an object such as a lighting fixture disposed centrally of the rings is very difficult.

The prior art attempted to solve this problem by constructing chandelier baskets in two completely separable pieces, whereby a lower portion of the basket could be completely removed from the upper portion of the basket, so as to provide access to the central, internal region defined by the basket. This solution, however, presented many drawbacks. For example, once the lower portion was removed, it either was necessary to have an individual handy to hold the lower portion while another person serviced the chandelier, or it was necessary to place the lower portion onto a surface. Requiring an lower frameworks with respect to one another as the frameworks are moved along a displacement axis from the decorative position to the access position.

The chandelier of the invention, thus, easier to service and is potentially less expensive to service. In addition, it provides a structure whereby the ornaments are less likely to become dislodged or damaged during servicing. These and other features of the invention are described in greater detail below in connection with the drawings.

SUMMARY OF THE INVENTION

The invention provides an improved chandelier of the type carrying a plurality of trimmings and having an upper framework carrying some of the trimmings and a lower framework carrying others of the trimmings. The upper and lower frameworks are moveable and detachably securable at two discrete positions with respect to one another. The positions may comprise an access position and a decorative position and the chandelier may include a lighting element enclosed by the frameworks, whereby access to the lighting element is facilitated in the access position relative to the decorative position.

Figure 5:
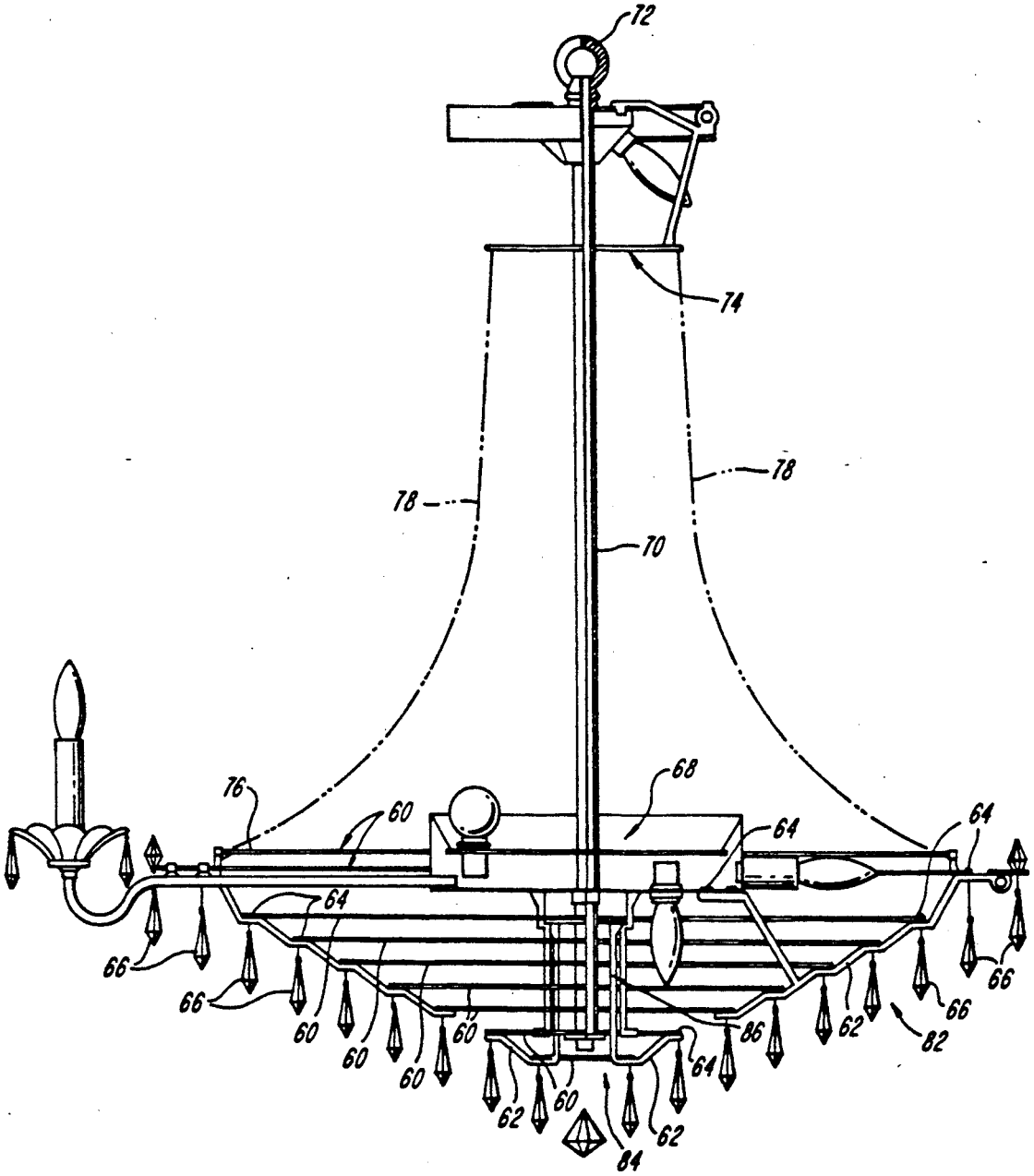
FIG. 5 is a schematic, cross sectional additional individual just to hold the lower portion during servicing can be extremely inconvenient and potentially expensive if servicing is performed professionally. Placing the lower basket onto a surface also is problematic because the basket usually carries a large number of trimmings, such as crystals, which may become disengaged from the framework or even damaged.
Figure 6:
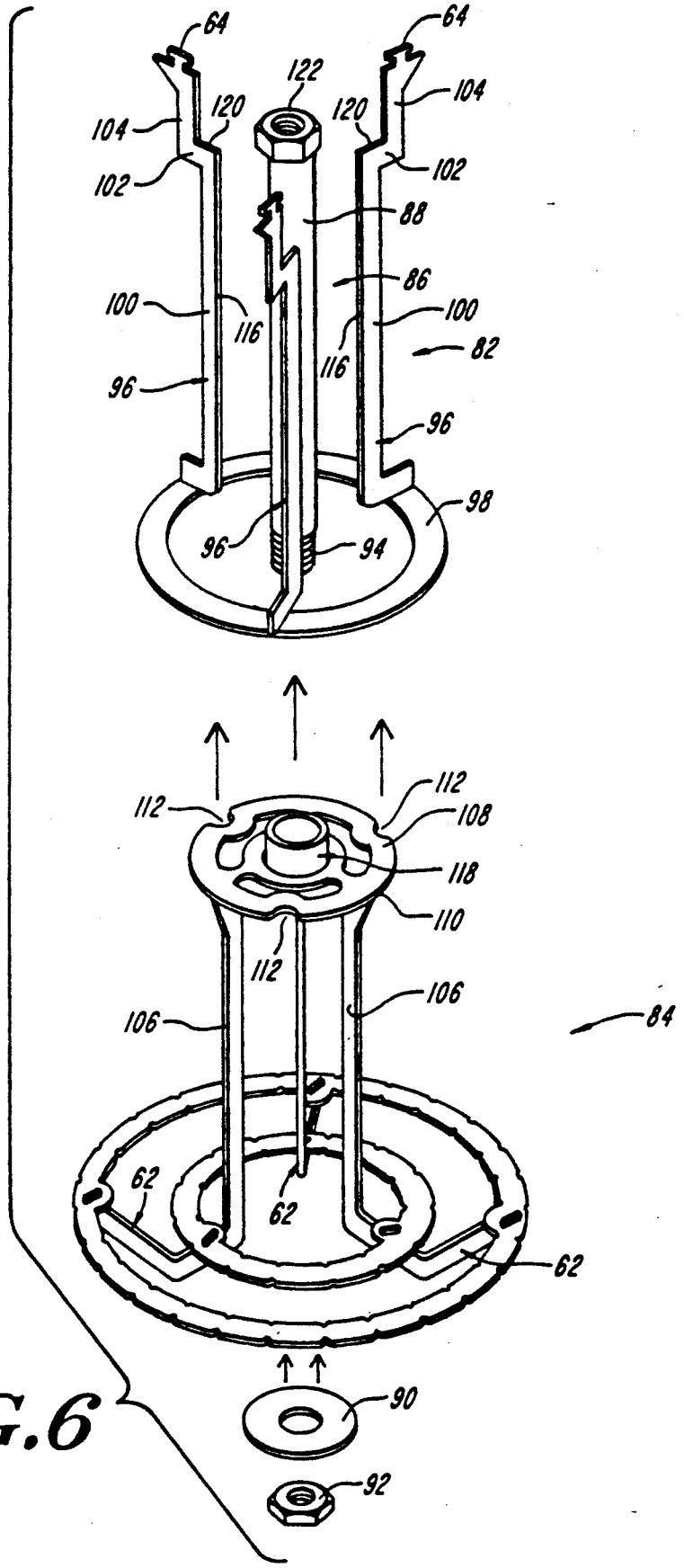
Figure 7:
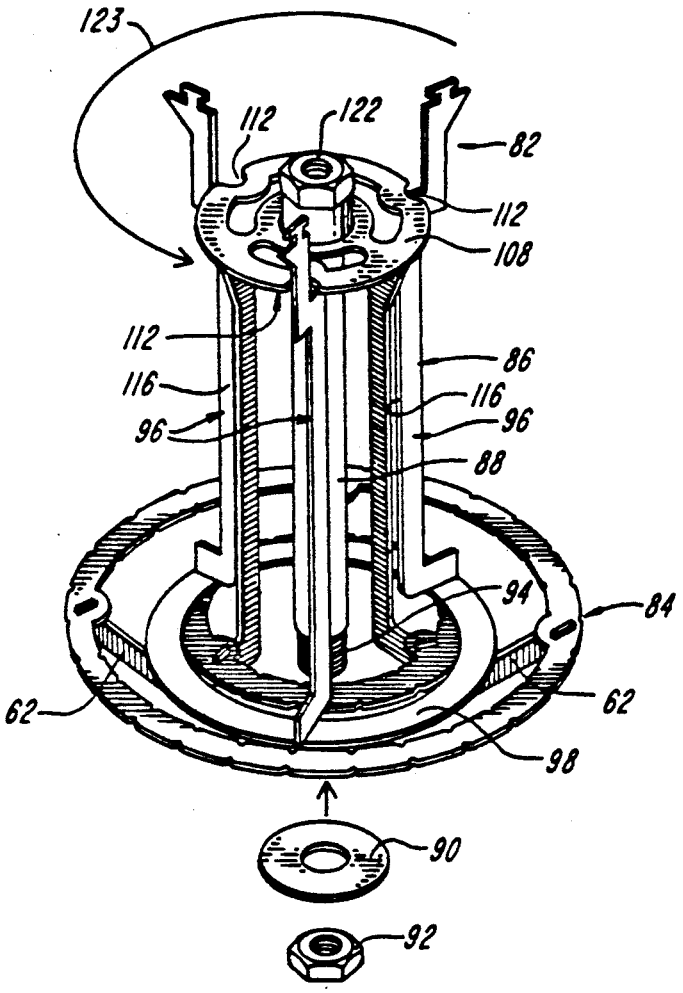
Figure 8:
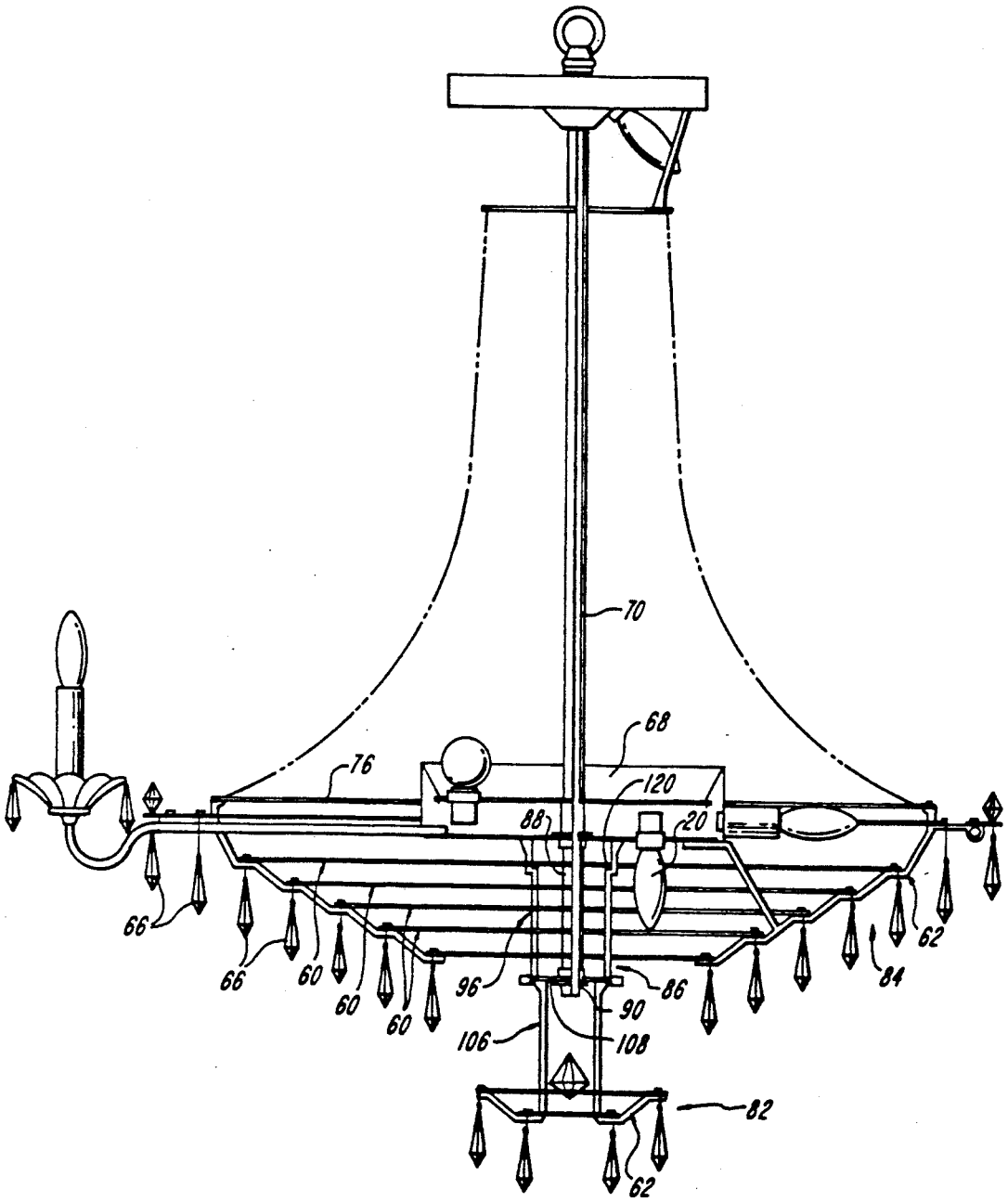
Figure 9:
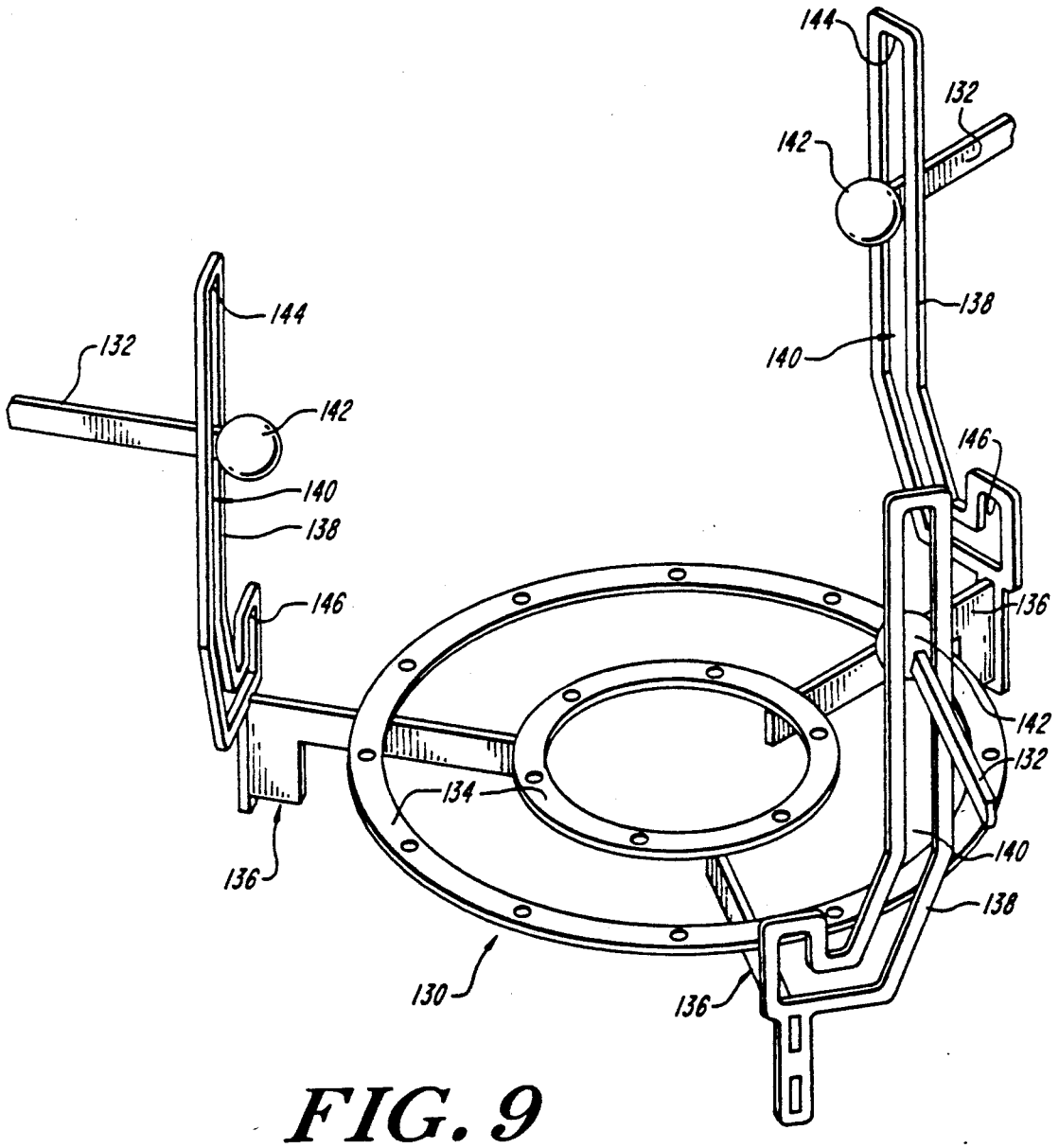

According to one aspect of the invention, the upper and lower frameworks are slideably attached to one another and according to another aspect of the invention, the frameworks are constructed with guides for guiding the movement of the upper and representation of another two-piece chandelier according to the invention;

FIG. 6 is an exploded schematic, perspective representation of the framework portions of FIG. 5 that interengage to permit a decorative and an access position;

FIG. 7 is a schematic, perspective representation of the framework elements of FIG. 6 engaged in the decorative position; and FIG. 8 is a schematic, cross-sectional view of the chandelier of FIG. 5, with the frameworks in the access position; and FIG. 9 is a schematic, perspective representation of the operative elements of yet another embodiment of the invention.

DETAILED DESCRIPTION OF THE PREFERRED EMBODIMENTS

Figure 1:
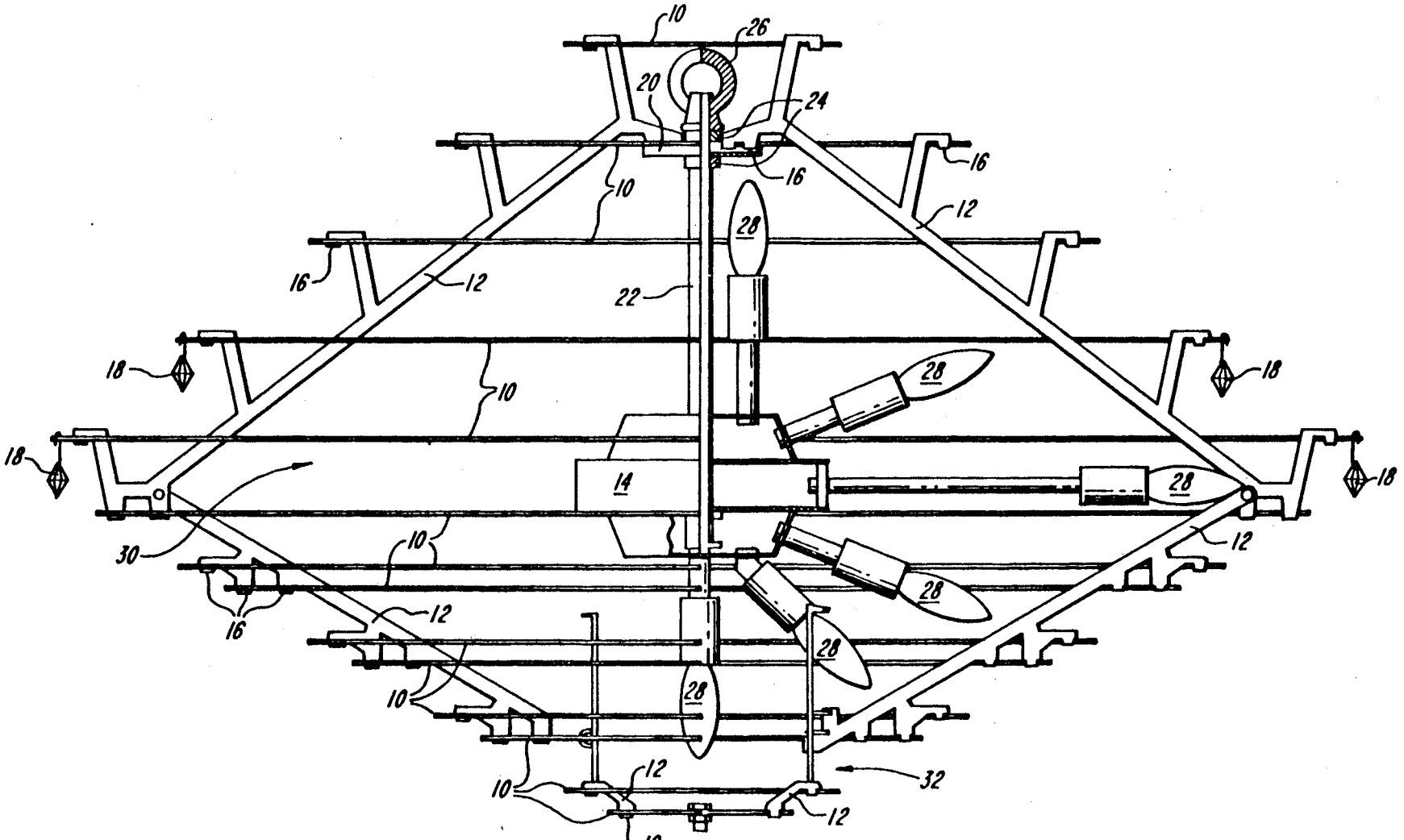
FIG. 1 is a schematic, cross-sectional representation of a two-piece chandelier according to the invention, the two frameworks being disposed in the decorative position.
Figure 2:
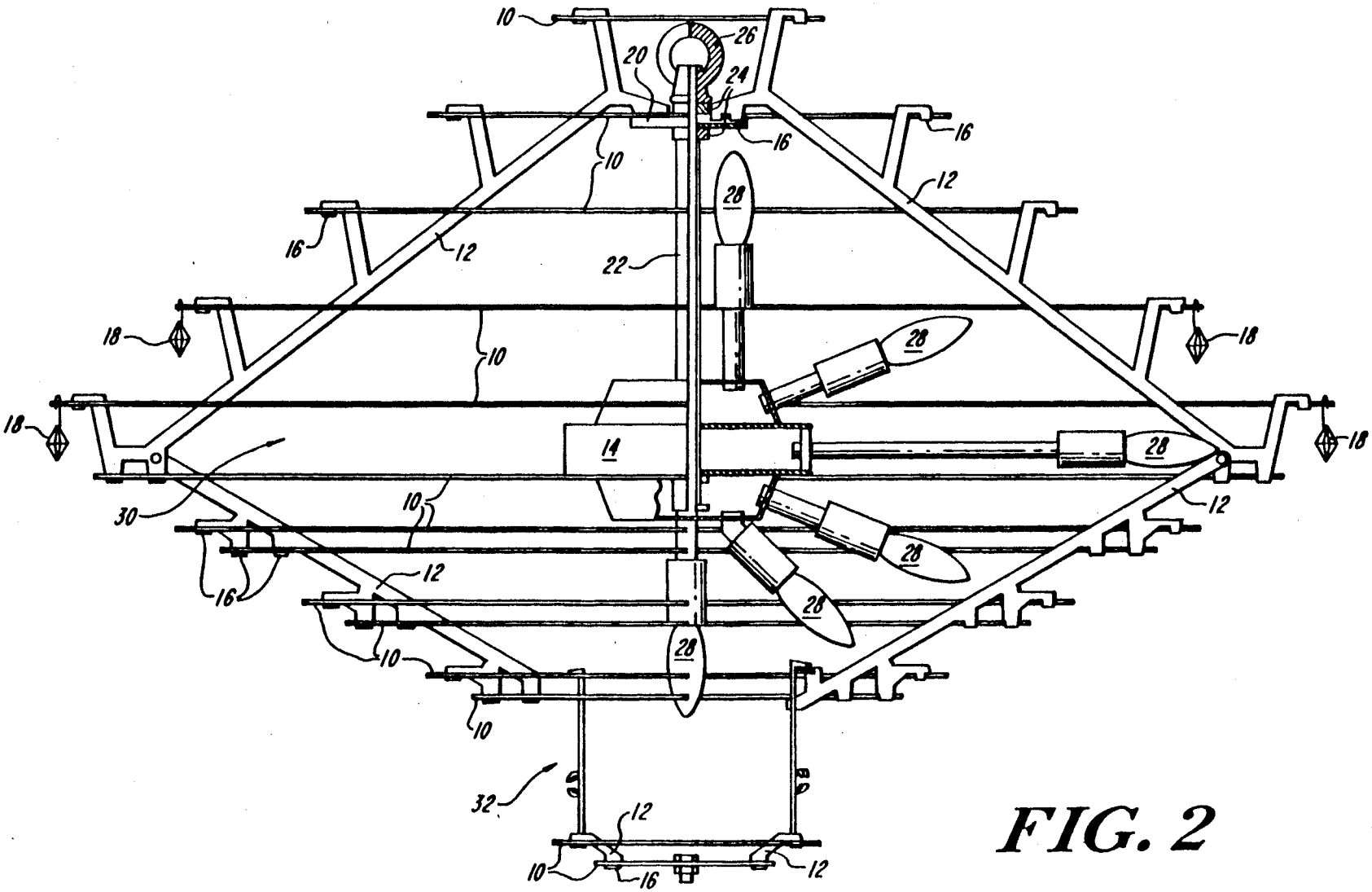
FIG. 2 is a schematic, cross sectional representation of the chandelier of FIG. 1, with the frameworks disposed in the access position.

FIGS. 1 and 2 illustrate a two-section chandelier framework according to the invention. The framework is constructed of rings 10 and spokes 12, preferably of the type described in U.S. Pat. application Ser. No. 07/539,854, filed Jun. 18, 1990 and entitled "Precision Chandelier Frame", the entire disclosure of which is incorporated herein by reference.

The rings 10 are arranged co-axially, disposed about and relative to a centerpiece 14. The rings are aligned and separated from each other by attachment to the spokes 12 radially positioned relative to the centerpiece 14. The rings define parallel planes and the spokes define planes substantially perpendicular to these parallel planes. The planes of the spokes generally are oriented vertically in use, contributing to the strength of the frame.

The rings 10 and spokes 12 are attached to one another by tabs 16 formed in the spokes and engaging integrally formed through-cut slots cut at predetermined locations in the rings. The tabs and slots allow for positive mechanical interengagement of the rings 10 and spokes 12. The tabs and slots also precisely align the rings radially relative to one another and to the spokes. Through this interengagement, the rings then are secured in position against rotation about the centerpiece 14 and against displacement radially relative to the centerpiece. As such, trimmings such as ornaments 18 depending from different rings maintain a precise alignment with respect to one another for an enhanced optical effect.

The spokes 12 are attached near the top of the chandelier to a top plate 20 which further provides structure for aligning the spokes with respect to one another and enhancing the overall structural rigidity of the frame. The top plate 20 also provides structure for supporting the centerpiece 14.

From bottom to top, the rings first increase in diameter and then decrease in diameter, thereby forming an overall shape of a diamond in cross section. Together the rings form a cage or basket enclosing the centerpiece 14.

The centerpiece 14 of this embodiment is a lighting fixture located centrally of the rings within the cage. The centerpiece 14 is suspended within the cage by a central rod 22 extending co axially with the rings through the top plate 20. The central rod 22 is attached near one end to the top plate 20 by a pair of nuts 24 and at the other end to the centerpiece 14. An eye ring 26 is attached to the very end of the central rod 22 extending through the top plate 20. The eye ring 26 provides a structure for hanging the chandelier from a ceiling.

Figure 3:
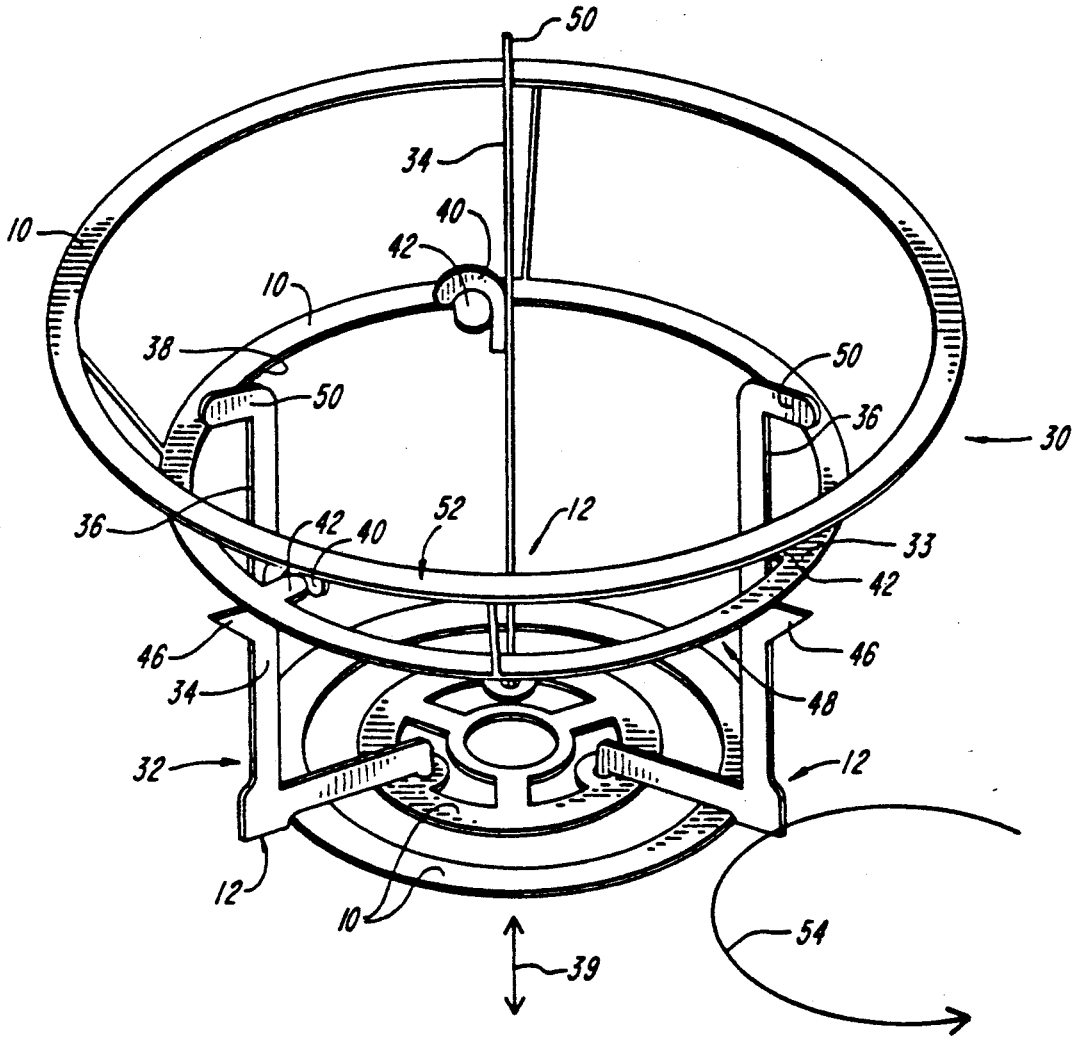
FIG. 3 is a schematic, perspective representation of a portion of the chandelier of FIGS. 1 and 2, illustrating the operative elements of the frameworks in the decorative position.
Figure 4:
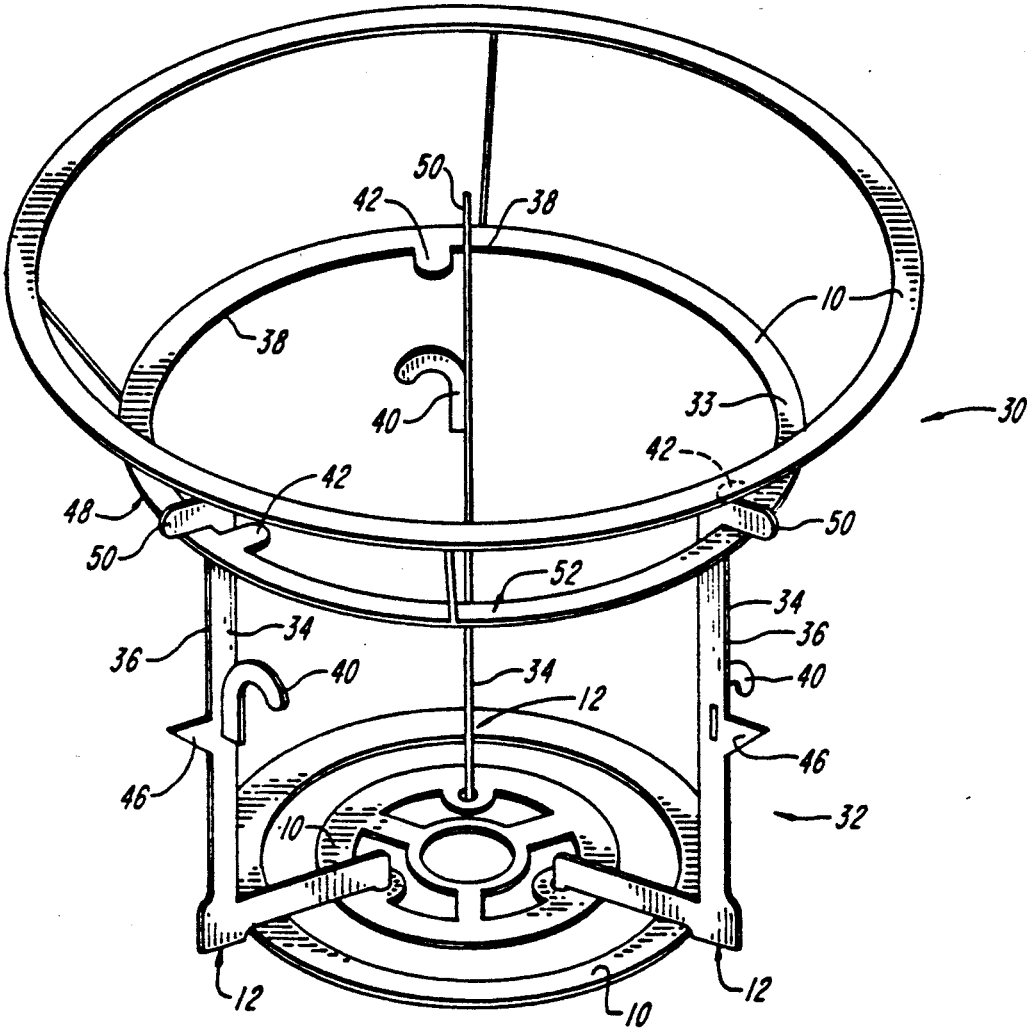
FIG. 4 is a schematic, perspective representation of the framework elements shown in FIG. 3, but in the access position.

The centerpiece 14 carries a plurality of bulbs 28. As will be readily understood, the bulbs are not easily accessible due to the obstruction created by the rings and any associated trimmings. To solve this problem, the chandelier is formed of an upper framework 30 and a lower framework 32, moveable and detachably securable at two discrete positions with respect to one another. A first position, or decorative position, is shown in Figs. 1 and 3, and a second position, or access position, is shown in FIGS. 2 and 4. The decorative position is that position in which the upper and lower sections of the framework are assembled with their decorative trimmings in place to produce the desired overall decorative pattern. This position does not usually include substantial space between the rings and between the trimmings. Rather, the trimmings tend to be closely spaced upon the overall framework in the decorative position in order to obtain a predetermined overall appearance. It should be again noted that, in general, with the trimmings and frame members supporting them so closely spaced, access to the interior of the frameworks is difficult.

In the access position, on the other hand, the frameworks are separated by a space that is sized and located such that a person s hand may be inserted into the interior of the framework to manipulate an object such as a light bulb.

To better illustrate the operative structures of the chandelier of Fig. 1, the lower framework 32 and the bottom two rings of the upper framework 30 are shown schematically in the decorative position in Fig. 3. The lower framework 32 has spokes 12 that include leg segments 34 extending upwardly from the rings 10 of the lower framework 32. The leg segments 34 extend parallel to an axis defined by the direction of orientation of the co axial rings 10 and are spaced evenly from one another and from that axis. The leg segments 34 are constructed and arranged such that their outwardly facing surfaces 36 are spaced only slightly from the inwardly facing surface 38 of the bottom ring of the upper framework 30. In this manner, the lower framework is capable of being moved toward or away from the upper framework, guided by the leg segments 34. This movement is generally along an axis which for the purposes of this invention is the displacement axis. In most instances, the displacement axis is disposed in alignment with the hanging orientation of the chandelier as well as the axis defined by the co-axial rings. See, in particular, the arrow 39 defining the displacement axis in FIG. 3. However, it should be clear to one of ordinary skill in the art that the displacement axis may be positioned orthogonally relative to the hanging orientation or even horizontally. For the purposes of this invention, axial movement means movement along the displacement axis. Nonaxial movement, then, is movement other than along the displacement axis. For example, nonaxial movement includes rotational movement of the lower framework relative to the upper, as will be discussed in greater detail below.

The chandelier of this embodiment is constructed and arranged to permit the upper and lower frameworks to be secured with respect to one another along the displacement axis at two discrete positions. The frameworks are secured in these positions by interengaging formations on the upper and lower frameworks.

In the decorative position, the lower framework of Figs. 1–4 has side hooks 40 extending from the leg segments 34. These side hooks 40 are constructed and arranged for interengagement with a shoulder or protrusion 42 located on the bottom ring 33 of the upper framework 30. The protrusion 42 is a formation on the bottom ring 33 extending radially inwardly from the inner circle defined by the bottom ring 33. Thus, in the decorative position (Fig. 3), the lower framework hangs from the upper framework through the interengagement of the side hooks 40 and protrusions 42.

To disengage the lower framework 32 from the upper framework 30, the lower framework is moved upwardly until the protrusions 42 no longer are capable of providing rotational interference with respect to the side hooks 40. To assist in determining when sufficient upward movement has occurred, the leg segments 34 are provided with stops 46 formed integrally with the leg segments 34 and projecting radially outwardly from the leg segments 34. The stops 46 are positioned just below the hooks 40, and engage the downwardly facing surface 48 of the bottom ring 33 when clearance between the side hooks 40 and protrusions 42 has been achieved. Once clearance has been achieved, the lower framework 32 then is rotated to bring the side hooks 40 out of alignment with the protrusions 42. Once out of alignment, the lower framework 32 may be lowered, guided by the leg segments 34 into the access position (Fig. 4) in which the lower and upper frameworks are relatively separated, thereby providing a space permitting access to the centerpiece.

As shown in Fig. 4, the lower framework is supported in the access position by terminal hooks 50 integrally formed with the leg segments 34 at the upper end of the leg segments. Like the stops 46, the terminal hooks 50 project radially outwardly from the leg segments 34 and are constructed and arranged to interengage with the ring 33 to prevent further downward movement of the lower framework 32 with respect to the upward framework 30. Unlike the stops 46, the terminal hooks 50 engage the upwardly facing surface 52 of the bottom ring 33.

When servicing has been completed, the chandelier may be repositioned in the decorative position by moving the lower framework 32 upwardly until the stops 46 on the leg segments 34 contact the bottom ring 44 thereby preventing further upward movement. The lower framework 32 then is rotated in the direction of arrow 54 of Fig. 3 to align the side hooks 40 with the protrusions 42. Then, the lower framework 32 is slightly lowered with respect to the upper framework 30 to cause the side hooks 40 to interengage with the protrusions 42. It will be understood that the side hooks 40 extend at an angle with respect to the terminal hooks 50 since the side hooks must be positioned such that they pass within and do not engage the bottom ring 33 of the upper framework during their movement along the displacement axis between the access position and the decorative position. It further should be understood that the leg segments 34 may be constructed and arranged such that the top portion carrying the terminal hooks 50 are capable of flexing radially inwardly. In this manner, the device may be manufactured and assembled easily, simply by snap fitting the leg segments upon the inner circumference of the bottom ring 33 of the upper framework 30.

Fig. 5 illustrates another embodiment of the chandelier according to the invention. This chandelier also is constructed of rings 60 and spokes 62 attached to one another by tabs 64. The rings support ornaments 66 and a centerpiece 68 is located substantially centrally of the rings 60.

In this embodiment, the rings are co axial and are of increasing diameter from bottom to top, thereby forming a basket open at the top. Extending concentrically from within the basket to a location remote from and above the top of the basket is a central rod 70. The centerpiece 68 is attached to the central rod, and the spokes 60 in turn are attached to the centerpiece 68 thereby indirectly attaching the cage to the central rod as well. At the top of the central rod 70 is an eye hook 72 for hanging the chandelier from the ceiling. Near the eye hook, a top plate 74 is attached to the central rod 70. Draped from this top plate 74 and extending to the uppermost ring 76 of the chandelier are strings 78 of ornaments. Thus, although the basket is not closed by rings at its top, the draped ornaments act to surround and enclose the top of the basket, making access to the centerpiece 68 difficult, particularly when the centerpiece includes bulbs 80 which extend downwardly from the centerpiece.

To provide access to the centerpiece and particularly to the downwardly extending bulbs 80, the framework is formed of an upper framework 82 and a lower framework 84 capable of movement with respect to one another along a displacement axis and capable of being secured in a decorative position (Figs. 5 and 7) and an access position (Fig. 8).

To better illustrate the operative structures of the chandelier, the relevant portions of the upper framework 82 as well as the entire lower framework 84 are shown in an exploded, schematic representation in FIG. 6. The upper framework 82 includes a guiding element 86 positioned centrally of the ornament rings. The guiding element 86 includes a centrally disposed guide rod 88 axially aligned with and attached to and extending from the bottom of the central rod 70. Attached to the bottom of the guide rod 88 is a washer 90 held in place by a nut 92 threaded onto threads 94 located at the bottom of the guide rod 88. This washer 90 acts as a stop preventing further downward movement of the lower framework with respect to the upper framework, as is described in greater detail below. The guiding element also includes three guide legs 96, parallel to and radially disposed about the guide rod 88. The guide legs 96 are attached at their top to the centerpiece 68 and at their bottom are attached to one another by a guide support ring 98. The guide legs 96 have three segments, a first upwardly extending segment or guiding segment 100, a second outwardly extending segment or shoulder segment 102 and a third upwardly extending segment or attachment segment 104. The purpose of this configuration will be described in detail below.

The lower framework has three spokes 62 which include spoke leg segments 106, oriented parallel to one another, parallel to the central axis defined by the co axial rings and extending upwardly from the lower framework rings. The spoke leg segments 106 are attached at their top to a guide plate 108 oriented substantially perpendicular to the axes defined by the spoke leg segments 106. This guide plate 108 defines an outer perimeter, the surface 110 of which is substantially circular except for indentations or notches 112 in that surface. The notches 112 are sized to receive the guide legs 96 when aligned with the guide legs. Thus, the outer facing surfaces 114 defining the notches 112 are spaced only slightly from the inwardly facing surfaces 116 of the guide legs 96. In this manner, the lower framework 84 is capable of being moved toward or away from the upper framework 82 along the displacement axis, guided by the guide legs 96 and notches 112.

The center of the guide plate 108 is provided with an opening, preferably lined with a plastic bushing 118. The plastic bushing 118 is sized to slideably receive the guide rod 88, further providing guiding structure for the movement of the upper and lower frameworks with respect to one another along the displacement axis.

The foregoing structure permits the frameworks to be locked and secured in an access position and a decorative position. In the access position, shown in Fig. 8, the lower framework 84 is supported from further downward movement with respect to the upper framework 82 by the interengagement of the downwardly facing surface of the guide plate 108 with the upwardly facing surface of the washer 90. Thus, the washer must define a structure that is larger than the opening defined by the plastic bushing to prevent the guide plate 108 from sliding off the bottom of the guide rod 88. To secure the frameworks in the decorative position (FIGS. 5 and 7), the lower framework 84 is moved upwardly along the displacement axis with respect to the upper framework 82 until the guide plate 108 is positioned above the ledges 120 formed by the upwardly facing surfaces of the shoulder segments 102 of the guide legs 106. This positioning may be indicated by constructing the frameworks such that the upper end of the plastic bushing 118 interferes with further upward movement of the lower framework 84 by contacting the downwardly facing surface of the nut 122 (located at the joint between the guide rod 88 and the central rod 70) when the guide plate 108 is located above the ledges 120. Then, the lower framework 84 may be rotated (arrow 123 in FIG. 7) with respect to the upper framework 82 to move the notches 112 out of alignment with the guide segments 100 of the guide legs 96, thereby positioning the downwardly facing surface of the guide plate 108 above the ledges 120. The lower framework then may be moved axially away (lowered) from the upper framework to rest the guide plate 108 upon the ledges 120 (the decorative position).

Another embodiment of the invention is shown in FIG. 9, in which a lower framework 130 is slidably attached to the guide spokes 132 of an upper framework (not shown). The lower framework 130 has a pair of coaxial rings 134 attached to and supported by lower framework spokes 136. Extending upwardly from the lower framework spokes 136 are guide legs 138. The guide legs extend parallel to one another and are parallel to and evenly spaced from the axis that is perpendicular to the center of the plane defined by the coaxial rings.

The guide legs 138 are substantially J-shaped Formed in the guide legs 138 are J-shaped guide channels 140. The guide spokes 132 of the upper framework are positioned through the guide channels 140 and terminate just radially inwardly of the guide channels 140. Oversized stops 142, which in this embodiment are spherical, are attached to the radially inward end of the guide spokes 132 (by interengaging threads, not shown) to prevent disengagement of the guide spokes 132 from the guide legs 138.

In operation, the lower framework 130 may be moved along the displacement axis into and out of the access and decorative positions by movement of the guide spokes 132 with respect to the guide channels 140. In the access position, the guide spokes 132 are positioned to engage downwardly facing surfaces 144 defining the upper ends of the J-shaped guide channels 140. In the decorative position, the guide spokes 132 are positioned to engage downwardly facing surfaces 146 defining the lower ends of the J-shaped guide channels.

Having described the invention in detail, those skilled in the art will appreciate that numerous modifications can be made thereof without departing from the scope and spirit of the invention. Therefore, it is not intended that the invention by limited to the embodiments illustrated and described. Rather, the scope of the invention is to be determined by the appended claims and their equivalents.

What is claimed is:

1. A chandelier of the type carrying a plurality of trimming comprising:

an upper framework carrying some of the trimmings and defining an interior, and a lower framework carrying other of the trimmings, wherein the upper and lower frameworks are moveable and detachably securable at two discrete positions with respect to one another, one of the discrete positions with respect to one another, one of the discrete positions being a first position in which the trimmings form a predetermined decorative pattern and the other being a second position in which the predetermined decorative pattern is interrupted by separation of the trimmings on the upper framework from the trimmings on the lower framework, thereby providing an opening between the trimmings permitting access to the interior.

2. A chandelier of the type carrying a plurality of trimmings comprising, an upper framework carrying some of the trimmings, a lower framework carrying other of the trimmings, and a lighting element attached to the upper framework nd enclosed by said frameworks, wherein the upper and lower frameworks are moveable and detachably securable at two discrete positions with respect to one another and wherein said two discrete positions comprise an access position and a decorative position, whereby access to the lighting element is facilitated in the access position relative to the decorative position.

3. A chandelier as claimed in either of claims 1 or 2 further comprising means for slideably attaching the upper and lower frameworks to one another.

4. A chandelier as claimed in claims 1 or 2 further comprising means for guiding the movement of the upper and lower frameworks with respect to one another as the frameworks are moved from the decorative position to the access position.

5. A chandelier as claimed in claim 4 wherein the means for guiding the movement is a tube located centrally of the frameworks.

6. A chandelier as claimed in claim 4 wherein the means for guiding the movement includes framework legs disposed substantially along the displacement axis.

7. A chandelier as claimed in claim 6 wherein the framework legs interengage with slots for guiding the movement of the frameworks with respect to one another.

8. A chandelier as claimed in claims 1 or 2 wherein the upper framework has legs which are constructed and arranged to interengage with the lower framework to detachably secure the upper framework to the lower framework in one of the two discrete positions.

9. A chandelier as claimed in either of claims 1 or 2 wherein the lower framework has legs which are constructed and arranged to interengage with the upper framework to detachably secure the upper framework to the lower framework at one of the two discrete positions.

10. A chandelier as claimed in either of claims 1 or 2 wherein the frameworks are detachably securable to one another at least one of the two discrete positions by non axial movement of lower framework with respect to the upper framework.

11. A chandelier as set forth in claim 10 wherein the frameworks are detachably securable to one another at at least one of the two discrete positions by rotating the lower framework with respect to the upper framework.

12. A chandelier as claimed in claim 1 wherein the frameworks are detachably securable to one another at at least one of the positions by transverse shoulders on framework legs disposed substantially along the displacement axis.

13. A chandelier as claimed in claim 12 wherein each leg carries at least two shoulders, one for securing the framework in one of said two discrete positions and the other for securing the frameworks in the other of said two discrete positions.

14. A chandelier as claimed in claim 13 wherein the at least two shoulders project at angles with respect to one another.

15. A chandelier as claimed in claim 14 wherein the transverse shoulders interengage with a ring to secure the frameworks in at least one of the two discrete positions.

16. A chandelier as claimed in claim 15 wherein the ring includes slots that interengage with the support legs for guiding the movement of the frameworks with respect to one another as the frameworks are moved between the two discrete positions.

17. A chandelier as claimed in claim 12 wherein the legs may be flexed elastically whereby the upper and lower frameworks may be engaged with and disengaged from each other.

18. A chandelier as claimed in either of claims 1 or 2 further comprising stops to limit movement beyond at least one of the two discrete positions.

19. A chandelier as claimed in claim 18 wherein at least one of the stops comprises a nut positioned upon a tube located centrally at the frameworks.

20. In a chandelier of the type including a basket formed of axially aligned rings, the improvement comprising a moveable portion of the basket securable at a first location to form a decorative arrangement of the chandelier and securable at a second location for providing access to an internal region of the basket.

21. The improvement of claim 20 further comprising a lighting element located in the internal region of the basket, and wherein access to the lighting element is facilitated by moving the moveable portion of the basket to the second position.

22. The improvement of claim 20, wherein the moveable portion includes guide legs defining guide channels for guiding movement of the moveable portion.

23. The improvement of claim 22, wherein the guide channels are each formed in a J-shape.

24. A chandelier as claimed in claims 1 or 2 wherein one of the upper framework and lower framework includes a plurality of legs, each leg defining a shoulder, and wherein the other of the upper framework and lower framework includes a ring for engaging the shoulders in one of the two discrete positions.

25. A chandelier as claimed in claim 4 wherein the means for guiding the movement of the frameworks includes a slotted ring.

26. A chandelier as claimed in claim 4 wherein the means for guiding the movement of the frameworks comprises a ring on one of the upper framework and lower framework and a plurality of legs on the other of the upper frame and lower framework, the legs having radially outwardly facing surfaces spaced radially inwardly from a radially inwardly facing surface of the rings.

27. A chandelier as claimed in claim 4 wherein the means for guiding the movement of the frameworks includes nontubular legs, each leg defining an axially-extending, substantially-planar surface.

28. A chandelier as claimed in claim 4 wherein the means for guiding the movement of the frameworks includes a plurality of slots formed in one of the upper framework or lower framework and a plurality of legs attached to the other of the upper framework and lower framework, the legs adapted to slideably engage the slots.

29. A chandelier as claimed in claim 4 wherein the means for guiding the movement of the frameworks includes legs defining guide channels.

* * * * *